United States Patent [19]

Reinhall

[11] 4,163,525

[45] Aug. 7, 1979

[54] DEVICE FOR EVACUATING BLOW-BACK STEAM IN PULP REFINING APPARATUS

[76] Inventor: Rolf B. Reinhall, 834 171 Place, NE., Bellevue, Wash. 98008

[21] Appl. No.: 864,313

[22] Filed: Dec. 27, 1977

[30] Foreign Application Priority Data

Jan. 3, 1977 [SE] Sweden ..... 7700047

[51] Int. Cl.[2] ..... B02C 7/00; B02C 23/02; B02C 23/26; D21B 1/12

[52] U.S. Cl. ..... 241/247; 162/46; 162/47; 162/261; 241/244

[58] Field of Search ..... 162/261, 23, 46, 47, 162/48; 241/244, 245, 246, 247

[56] References Cited

U.S. PATENT DOCUMENTS

| | | | |
|---|---|---|---|
| 3,921,918 | 11/1975 | Peterson | 162/23 X |
| 4,037,792 | 7/1977 | Peterson | 162/47 X |
| 4,059,237 | 11/1977 | Mannstrom | 241/246 |

FOREIGN PATENT DOCUMENTS

| | | | |
|---|---|---|---|
| 2183928 | 12/1973 | France | 241/244 |

*Primary Examiner*—Richard V. Fisher
*Attorney, Agent, or Firm*—Eric Y. Munson

[57] ABSTRACT

A device for evacuating blow-back steam in a pulp refining apparatus in which lignocellulosic pulp stock is ground in an environment of superatmospheric steam in a grinding space defined between a pair of grinding members which rotate relatively to one another in a closed housing having a feed-in opening into which the pulp stock is advanced by means of a feed screw which rotates within a feed-in passage. A jacket having a perforate wall is arranged about the feed-in passage for receiving the blow-back steam separated from the pulp stock, and which steam is evacuated therefrom through a conduit connected to the jacket. The feed screw rotates in close proximity to the perforate wall to maintain it free of pulp stock particles.

3 Claims, 3 Drawing Figures

42
38
28
40
44
46
48
43
52
56
58
60
18
16
14
13
12
20
21
22
23
24
26
50
51
54

DEVICE FOR EVACUATING BLOW-BACK STEAM IN PULP REFINING APPARATUS

BACKGROUND OF THE INVENTION

The present invention relates to a device for use in the manufacture of fiber pulp from lignocellulosic material, such as wood chips, comprising a refining apparatus with a refining gap for the comminution of the material between mutually rotatable refining elements, and a supply line for feeding the material into the refining gap. The invention is conceived in the first place for use in conjunction with refining apparatus of the type in which the refining elements are mutually rotatable discs subjected to thrust pressure and having a central supply duct to carry the material to the refining gap between the discs. However, the invention is not limited to this application, but can also be applied, for example, to refining apparatuses of the cylinder type, where the refining gap is formed between an outer cylindrical drum and a rotor that rotates inside the said outer drum. Of the energy supplied to the rotating element of the refining apparatus for the purpose of comminuting the material into fibers or fibrils, a large part is converted into heat, whereby steam is generated in the refining gap by the vaporization of the water accompanying the material. The volume of steam generated with the high energy inputs required by modern designs is very large, and to prevent the dry content of the material hereby reaching excessive values, it is a known practice to add water into the refining gap during the refining process in order to maintain in the desired water content of the material, thereby protecting the latter from damage by overheating.

It is a known practice to permit part of the generated steam to blow back into the fiber material supply line leading to the refining gap, and also to utilize this steam for pre-heating the material in a pre-heater before it is introduced between the refining discs. Another portion of the steam generated in the refining process passes along with the material through the gap between the refining discs, and is fed out therefrom together with the fiber pulp product. This implies that a zone of maximum steam pressure arises in the refining gap, being located somewhere near the middle of the refining space, with steam flowing in both directions from the said zone.

SUMMARY OF THE INVENTION

The invention contemplates with a device the object of which is to secure an even, steady supply of material to the refining space while at the same time effectively separating the stream of blow-back steam from the pulp material. This is essentially achieved by evacuating the blow-back steam generated in the refining space during the refining process, from the feed-in passage through an outlet comprising a steam screen that is adapted to interact with an element or elements for removing particles of material carried along by flow of the steam and screened off by the screening element. In a preferable embodiment, the said screening element is arranged so that, in the course of a rotary movement, it scrapes off the particles caught on that side of the screening element that faces the refining space, the screening element having in this case the form of a perforated plate or wall. The invention achieves the removal of the often large volumes of steam generated during the defibration or refining of the material, without disrupting the flow of material to the refining elements. Furthermore, the steam generated by the process can be utilized at the optimum steam pressure for the process, and in addition, the excess steam that is removed from the material stream is effectively freed from the untreated particles of material carried along by the steam. At least part of the steam that is blown back counter-current to the material stream can advantageously be utilized for preheating the untreated material.

BRIEF DESCRTIPTION OF THE DRAWINGS

The invention will be described below in closer detail with reference to the embodiment illustrated by way of example in the attached drawings, and FIGS. 1 and 2 show a side view and a plan, respectively, of an installation constructed according to the invention, with certain parts cut away for greater clarity.

FIG. 3 shows a cross-section of the material feed-in passage together with the steam screen, illustrated in perspective and on a somewhat larger scale.

DESCRIPTION OF A PREFERRED EMBODIMENT

Figure 1:
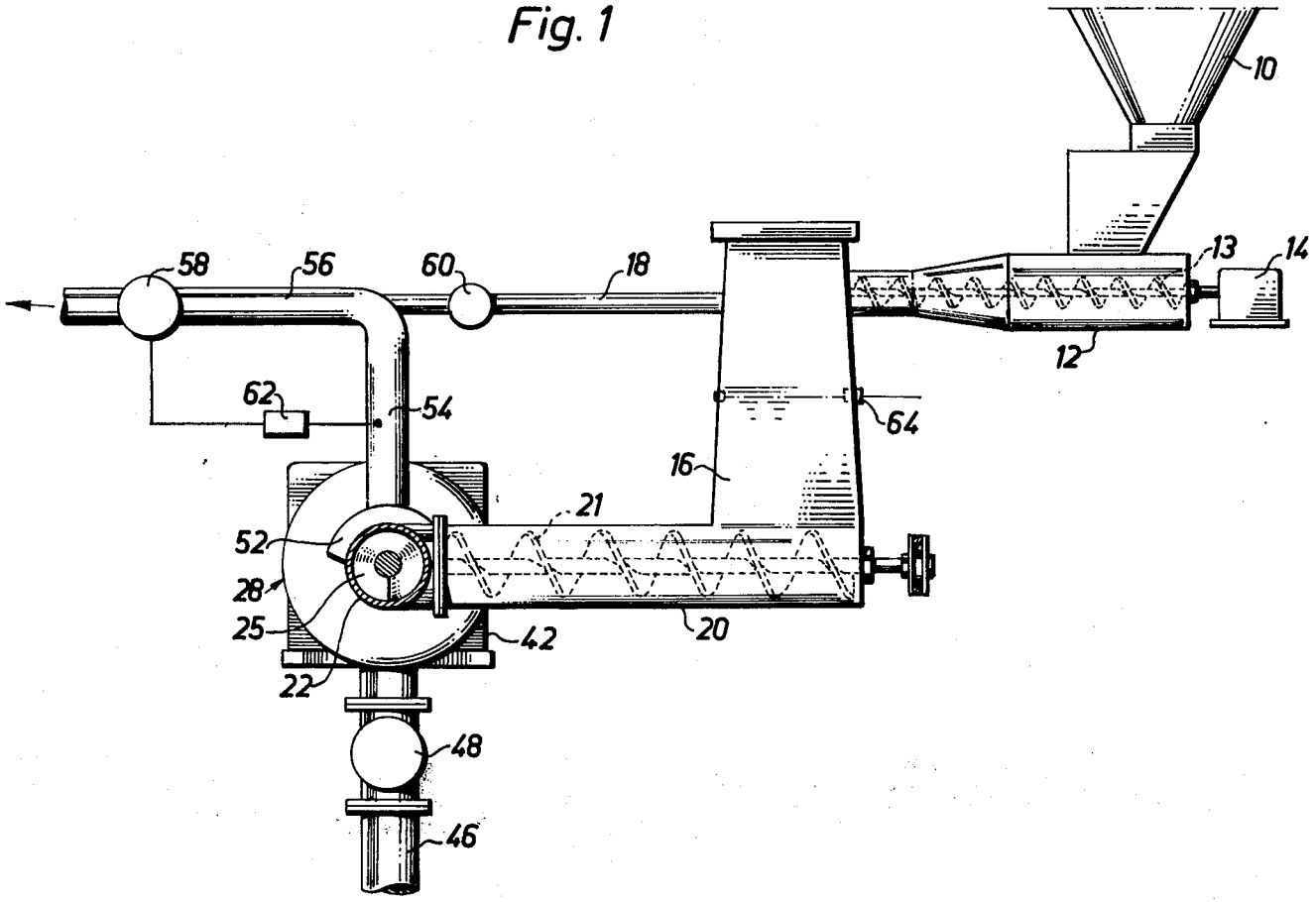

The numeral 10 on the drawings denotes a hopper through which the pulp material, e.g. in the form of wood chips, is supplied to a feed-in duct 12 which includes a conveyor screw 13 driven by a motor 14 and carries the material into a pre-heater 16. The conveyor screw forms a dense plug of the material, in a known manner, so that a steam and/or gas pressure exceeding atmospheric, and a matching temperature exceeding that of the atmosphere, are maintained in the pre-heater. The material is pre-heated in the latter by means of steam supplied via a line 18, as will be described below. A a screw conveyor passage 20–having its intake at the bottom of the pre-heater feeds the pre-heated chips to another conveyor passage 22, preferably also of screw type. The screws 21 and 23 of the two conveyors are driven by their respective motors, 24 and 26, and are positioned at an angle to each other in the embodiment presented. Conveyor 22 acts as the supply conduit for the pre-heated material to the refining apparatus denoted generally as 28, which may be a defibrator and/or refiner of disc type. In such a case, the refining apparatus will have two mutually rotatable refining discs, one of which, 38, in the embodiment presented, is rotatable and driven by a motor 42, while the other refining disc 40 is stationary. The latter disc is provided with a central passage 43 through which the material is introduced into the refining space 44 between the two discs. The material passes radially outward through the space, being comminuted so that the individual fibers and/or fibrils are seperated. The interior of the refining apparatus is kept under a pressure of steam, optionally in combination with a gas other than steam, and the fibrous pulp product leaves the refiner via a conduit 46 provided with a discharge valve 48. To generate the necessary refining pressure, the rotating refining element 38 is held against the stationary refining element 40 under a high thrust pressure in a known manner by means of a hydraulic servo-motor forming part of the drive 42.

Figures 2, 3:
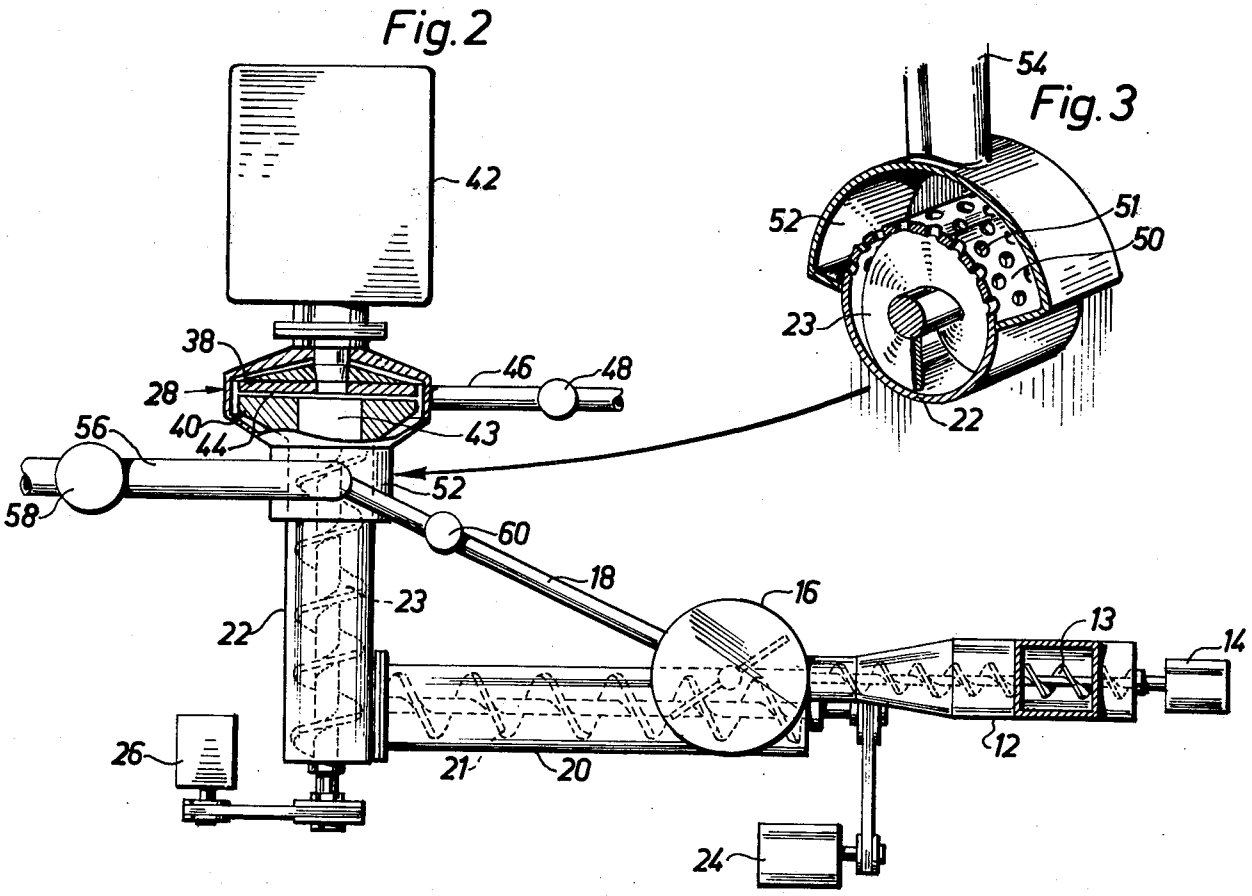

According to the invention, the material feed-in passage 22 to the refining apparatus 28, comprises a steam screen in the form of a perforated plate 50 forming part of the wall that closely encloses the screw 23 preferably in immediate proximity to the refining apparatus 26, as appears from FIG. 3. The outer periphery of the screw will thus act as a scraping element against the perforate plate 50. Spaced from the plate 50 is a jacket 52 opening into a steam line 54. The screening plate may extend around the entire circumference of the conveyor 22, but in the embodiment presented it comprises only the upper part thereof. The perforations in the screening plate may be formed as round holes 51, as shown, or as slits. Where the input material consists of sawdust or similar material, they will preferably have a diameter or a width, respectively, of 1 to 3 mm. Where the input material consists of conventional wood chips the said dimensions may be 3 to 12 mm.

The line 54 has one branch 56 which discharges steam from the system via a valve 58, while another branch 18 conducts high-pressure steam via a valve 60 back to the pre-heater 16, this latter stream of steam thus constituting the pre-heating medium for the input material. The steam pressure in the discharge line is adjusted by means of a regulator 62 which controls the valve 58. A level regulator 64 governs the speed of the feed screw 21 and thus maintains the quantity of material in the pre-heater 16 at the desired level.

As remarked above, a large part of the energy supplied to the rotating refining element 38 is converted into heat, which in its turn generates steam. Part of this steam leaves the refiner along with the fiber material product via discharge passage 46 and valve 48. Another portion of the steam flows counter current to the flow of material in the refining space, towards the material feed in passage, and this portion escapes through the perforations 51′ of the screening plate 50 into the jacket 52, from which it is passed via conduits 54, 56 and 18 to the discharge valve 58 and the preheater 16. By reason of the invention, the volume of steam generated, which may be very large, can now be evacuated in a controlled manner without interfering with the supply of material to the refining space of the apparatus. Particles of untreated material carried along with the flow of escaping steam are separated therefrom by the screening plate 50. At the same time, the interaction between the screw 23 and the screening plate 50 ensures that the screened-off particles are scraped off and returned to the stream of material flowing towards the refining space. In this manner the perforations will always be kept clear.

The invention is naturally not limited to the illustrated embodiment, but may be varied within the terms of the accompanying claims. Thus, the steam screen may be mounted to rotate and interact with stationary elements, which either continuously or periodically scrape off the screened-off particles. In certain cases the scraping effect can also be achieved by causing the screened-off particles of material are removed from the plate by screened-off particles of material are removed from the plate by centrifugal force. Besides mechanical means, the screening plate can also be cleaned by flushing with liquid or steam supplied under higher pressure than that maintained during the process.

What is claimed is:

1. In a pulp refining apparatus in which lignocellulosic pulp stock is ground in an environment of superatmospheric steam in a grinding space defined between a pair of grinding members which rotate relatively to one another within a closed housing having a stock inlet opening into which the pulp stock is advanced by means of a feed screw rotating within a feed-in passage connected to the stock inlet opening, the improvement for evacuating blow-back steam escaping through said stock inlet opening, comprising:

(a) jacket means having a perforate wall mounted about said feed-in passage for separating and receiving blow-back steam;

(b) conduit means for evacuating blow-back steam from said jacket means;

(c) said feed screw being effective to maintain said perforate wall free of pulp stock entrained in the blow-back steam.

2. A pulp refining apparatus according to claim 1, in which said jacket means is located adjacent said stock inlet opening.

3. A pulp refining apparatus according to claim 2, in which said perforate wall extends about only a portion of said feed-in passage.

* * * * *